US007905284B2

(12) United States Patent
Ross et al.

(10) Patent No.: US 7,905,284 B2
(45) Date of Patent: Mar. 15, 2011

(54) FRACTURING/GRAVEL PACKING TOOL SYSTEM WITH DUAL FLOW CAPABILITIES

(75) Inventors: Colby M. Ross, Carrollton, TX (US); Samuel Martinez, Cedar Hill, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 359 days.

(21) Appl. No.: 11/221,147

(22) Filed: Sep. 7, 2005

(65) Prior Publication Data

US 2007/0051507 A1 Mar. 8, 2007

(51) Int. Cl.
*E21B 43/04* (2006.01)

(52) U.S. Cl. ..... 166/278; 166/51

(58) Field of Classification Search ..... 166/51, 166/278

See application file for complete search history.

(56) References Cited

U.S. PATENT DOCUMENTS 2,205,422 A * 6/1940 Layne ..... 166/278
2,349,062 A * 5/1944 Uren ..... 166/278
2,716,454 A * 8/1955 Abendroth ..... 166/308.1
3,134,439 A * 5/1964 Shields, Jr. ..... 166/51
3,727,691 A * 4/1973 Muecke et al. ..... 166/295
3,884,301 A * 5/1975 Turner et al. ..... 166/278
4,064,941 A * 12/1977 Smith ..... 166/300
4,192,375 A * 3/1980 Maly et al. ..... 166/51
4,384,615 A * 5/1983 Luers ..... 166/326
4,662,447 A * 5/1987 Bolin ..... 166/278
5,417,284 A * 5/1995 Jones ..... 166/280.1
5,690,175 A * 11/1997 Jones ..... 166/278
5,765,642 A * 6/1998 Surjaatmadja ..... 166/297
6,427,775 B1 * 8/2002 Dusterhoft et al. ..... 166/278
6,776,235 B1 8/2004 England
2006/0113078 A1 * 6/2006 Nguyen et al. ..... 166/280.2

* cited by examiner

*Primary Examiner* — Zakiya W Bates
*Assistant Examiner* — Angela M Ditrani
(74) *Attorney, Agent, or Firm* — Marlin R Smith

(57) ABSTRACT

A fracturing/gravel packing tool system with dual flow capabilities. A method of treating a well includes the steps of: flowing a fluid into the well through a work string while simultaneously flowing another fluid into the well through an annulus; and directing each of the fluids to the exterior of a well screen in the well. A well treatment system includes a slurry and a fluid flowed into a well. The slurry has an initial density, but the fluid is mixed with the slurry in the well, thereby causing the slurry to have a reduced density in the well. Another method of treating a well includes the steps of: installing a gravel packing assembly including a well screen in the well; flowing a slurry and a fluid into the well; mixing the slurry with the fluid, thereby reducing a density of the slurry in the well; and flowing the reduced density slurry about an exterior of the well screen.

10 Claims, 9 Drawing Sheets

FRACTURING/GRAVEL PACKING TOOL SYSTEM WITH DUAL FLOW CAPABILITIES

BACKGROUND

The present invention relates generally to operations performed and equipment utilized in conjunction with a subterranean well and, in an embodiment described herein, more particularly provides a fracturing/gravel packing tool system with dual flow capabilities.

In conventional fracturing and gravel packing operations, a slurry is typically mixed to a desired density at the surface and then pumped into a well via a work string. Several factors limit the rate at which the slurry can be pumped through the work string. Among these factors are resistance to flow through the work string and erosion of the work string and other equipment.

In the past, such limitations have been dealt with by increasing the size of the work string to reduce flow resistance, and increasing the erosion resistance of the equipment. However, these solutions have been only partially successful. For example, in smaller casing sizes it may not be possible to substantially increase the size of the work string.

Furthermore, where the work string is thousands of feet long, changes in the slurry density cannot be quickly made to cope with unexpected circumstances, uncertainty in reservoir characteristics, or to enable selective fracturing of layers. Instead, changes in slurry density are made at the surface and the existing slurry already in the work string must be displaced before the changed density slurry reaches the formation.

Therefore, it may be seen that improvements are needed in well treatment systems and methods. It is among the objects of the present invention to provide such improvements.

SUMMARY

In carrying out the principles of the present invention, well treatment systems and associated methods are provided which solve at least one problem in the art. One example is described below in which a slurry is mixed with a fluid downhole, thereby reducing a density of the slurry in the well.

In one aspect of the invention, a method of treating a well includes the steps of: flowing a fluid into the well through a work string while simultaneously flowing another fluid into the well through an annulus formed between the work string and a wellbore; and directing each of the fluids to the exterior of a well screen in the well. Either or both of the fluids may be combined with proppant or gravel in a slurry. Mixture of a slurry with another fluid in the well may reduce a density of the slurry, or otherwise change a property of the slurry.

In another aspect of the invention, a well treatment system is provided. A slurry is flowed into a well, with the slurry having an initial property. A fluid is flowed into the well, with the fluid being initially separated from the slurry. The fluid is mixed with the slurry in the well, thereby causing the property of the slurry to change in the well. A flow rate of the fluid and/or the slurry may be altered to thereby produce corresponding changes in the property of the slurry during fracturing/gravel packing operations. The property could be a proppant density, fluid weight density, viscosity or other property of the slurry.

In yet another aspect of the invention, a method of treating a well includes the steps of: installing a gravel packing assembly in the well, the gravel packing assembly including a well screen; flowing a slurry into the well; flowing a fluid into the well; mixing the slurry with the fluid in the well, thereby reducing a density of the slurry in the well; and flowing the reduced density slurry about an exterior of the well screen.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It should be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

Figure 1:
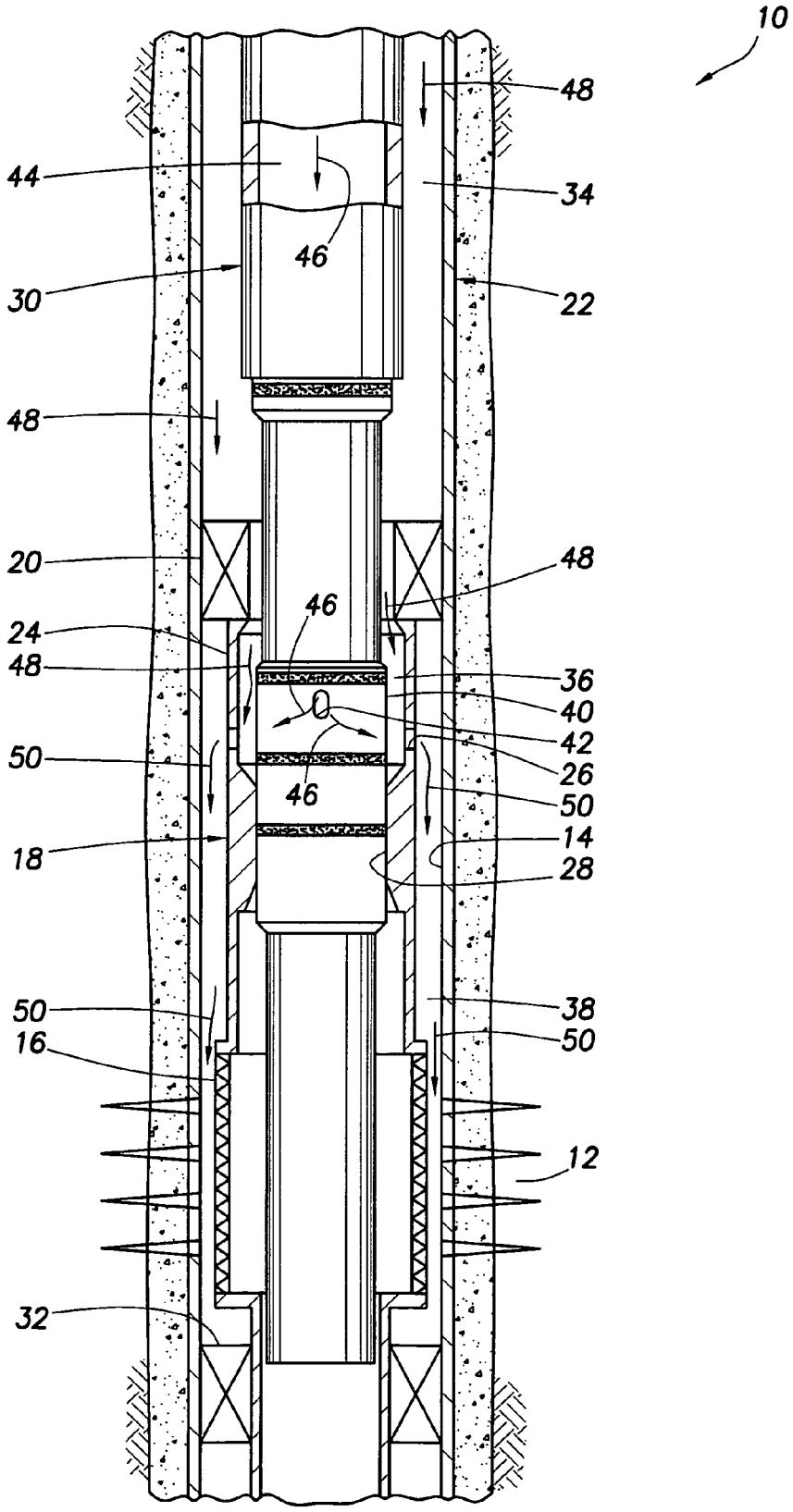
FIG. 1 is a schematic partially cross-sectional view of a first well treatment system and method embodying principles of the present invention.

Representatively illustrated in FIG. 1 is a well treatment system 10 and associated method which embody principles of the present invention. In the following description of the system 10 and other apparatus and methods described herein, directional terms, such as "above", "below", "upper", "lower", etc., are used for convenience in referring to the accompanying drawings. Generally, "above", "upper", "upward" and similar terms are used to indicate positions or directions toward the earth's surface along a wellbore, and "below", "lower", "downward" and similar terms are used to indicate positions or directions away from the earth's surface along a wellbore As depicted in FIG. 1, the system 10 is used in a well treatment which includes fracturing a formation or zone 12 intersected by a wellbore 14, and then gravel packing the wellbore about a well screen 16. However, it should be clearly understood that other types of operations could be performed in keeping with the principles of the invention. For example, fracturing or gravel packing operations could be performed without also performing the other.

As another example, operations such as acidizing, etc. could be performed, e.g., subsequent to a perforating operation. As used herein, the terms "well treatment" and "treating", and similar terms are used to indicate well operations such as fracturing, acidizing and other types of stimulation operations, gravel packing and other types of sand control operations, placing gels, binding agents, caustics and other types of chemicals in a zone, etc. Thus, the system 10 as illustrated and described herein is merely one example of a wide variety of systems which can utilize the principles of the invention.

The well screen 16 is included as part of a gravel packing assembly 18. The gravel packing assembly 18 also includes a packer 20 for sealing and anchoring the gravel packing assembly in a casing string 22 lining the wellbore 14, a tubular extension 24, ports 26 for communicating between the interior and exterior of the gravel packing assembly, and a seal bore 28 for sealing between the gravel packing assembly and a work string 30 positioned within the gravel packing assembly.

The screen 16, packer 20, extension 24, ports 26 and seal bore 28 may be of conventional design. Indeed, the entire gravel packing assembly 18 may be similar to conventional gravel packing assemblies used in the past and well known to those skilled in the art.

Of course, other components and fewer or greater numbers of components may be used in the gravel packing assembly 18, and the gravel packing assembly may be configured in a wide variety of combinations and arrangements of these components, in keeping with the principles of the invention. For example, a sleeve may be used to permit or prevent flow through the ports 26, additional seal bores may be provided, various manners of securing and/or positioning the work string 30 relative to the gravel packing assembly 18 may be used, multiple screens 16 may be used, a sump packer 32 may be sealingly engaged at a lower end of the gravel packing assembly, either an open hole or cased hole completion may be used, the gravel packing assembly 18 and work string 30 may be configured for treating only the single zone 12 or multiple zones, either in a single trip into the well or in multiple trips, etc. Thus, the gravel packing assembly 18 as illustrated and described herein is merely one example of a wide variety of assemblies which can be used in keeping with the principles of the invention.

The work string 30 is used to convey the gravel packing assembly 18 into the well and set the packer 20. Thereafter, the work string 30 is detached from the gravel packing assembly 18 so that the work string can be reciprocated to various positions relative to the gravel packing assembly, in a manner well known to those skilled in the art. Conventionally, the work string 30 includes an assembly at its lower end known to those skilled in the art as a "service tool", which is used in setting the packer 20, detaching the work string from the gravel packing assembly 18, directing flow to various flowpaths, etc.

As used herein, the term "work string" is used to indicate a tubular string which is used in the well treatment operation, for example, to convey or circulate fluids into and/or out of the well. A work string may also be used to convey and/or manipulate other equipment, such as the gravel packing assembly 18. A work string may be substantially made up of production tubing, drill pipe, other types of segmented tubing, continuous tubing (such as coiled tubing), a service tool and associated equipment, etc., and may be made of any type of material.

As used herein, the term "casing string" is used to indicate a tubular string which is used to permanently (or at least semi-permanently) line a wellbore. A casing string may be substantially made up of segmented casing or liner joints, continuous casing or liner, etc., and may be made of any type of material.

As depicted in FIG. 1, the work string 30 has been used to convey the gravel packing assembly 18 into the well. The packer 20 has been set in the casing string 22 (for example, by dropping a ball through the work string and applying pressure to the work string at the surface), and the work string has been detached from the gravel packing assembly.

The work string 30 has then been raised relative to the gravel packing assembly 18, so that an annulus 34 formed between the work string and the casing string 22 above the packer 20 is now in communication with an annular space 36 formed between the work string and the gravel packing assembly below the packer. In this manner, the annulus 34 is now in communication via the ports 26 with an annulus 38 formed between the gravel packing assembly 18 and the casing string 22 below the packer 20.

The work string 30 includes a crossover 40 with ports 42 therein which permit communication between an interior flow passage 44 of the work string and the annular space 36. In this manner, the interior flow passage 44 of the work string 30 is also in communication via the ports 26 with the annulus 38 below the packer 20.

In one method utilizing the system 10, a slurry 46 is pumped through the flow passage 44 and out into the annular space 36 via the ports 42 in the crossover 40. In other methods, the slurry 46 could instead be pumped through the annulus 34, as described below.

As used herein, the term "slurry" is used to indicate a combination of a fluid and a proppant or gravel (such as sand or a synthetic particulate, etc.). In fracturing operations, the slurry 46 would include a proppant to hold open fractures created by introduction of high pressure into the formation rock. In gravel packing operations, the slurry 46 would include gravel to prevent (or at least hinder) migration of formation sand to the well screen 16. Depending upon the circumstances, the proppant may be the same as, or different from, the gravel.

The slurry 46 may also include other components. For example, the slurry 46 could include gels, breakers, acid, ammonia, etc. Thus, a wide variety of different combinations of components may be used in the slurry 46 in keeping with the principles of the invention.

Another fluid 48 is pumped down the annulus 34 and into the annular space 36, where it mixes with the slurry 46. In other methods, the fluid 48 could instead be pumped through the passage 44 as described more fully below.

Preferably, the fluid 48 is a "clear" fluid, in that it has no proppant or gravel pumped with it. For example, the fluid 48 could be water, brine or another clear weighted fluid, etc. The fluid 48 could be pumped with gels, breakers, acid, ammonia, etc., mixed therein or pumped in stages. Note that a proppant or gravel could be mixed with the fluid 48 to form a slurry, if desired.

The slurry 46 is mixed with the fluid 48 in the annular space 36, and then exits the ports 26 into the annulus 38 below the packer 20 as a reduced density slurry 50. In a fracturing operation, the slurry 50 will be injected under high pressure into the zone 12, causing formation of fractures, with the proppant in the slurry being used to prop open the fractures. In a gravel packing operation (which may follow a fracturing operation), a portion of the fluid in the slurry 50 will flow into the zone 12, but a substantial majority of the fluid will flow into the screen 16 while the gravel is deposited in the annulus 38 external to the screen.

Many benefits may be derived from the system 10 and associated method as depicted in FIG. 1. One benefit is that the density (or another property) of the slurry 50 is produced in the well in close proximity to the zone 12 being treated. This allows the density or other property of the slurry 50 to be rapidly changed in response to changing or unexpected conditions downhole.

Various properties of the slurry 50 which may be changed downhole include proppant density, fluid weight density and viscosity. Any of these properties (and others) may be produced in the well in close proximity to the zone 12 being treated, and these properties may be changed continuously as the treatment operation proceeds.

For example, if after a fracturing operation has begun it is revealed that a density of the slurry 50 entering the zone 12 should be changed, a flow rate of the fluid 48 may be increased to lower the density of the slurry, or the flow rate may be decreased to increase the density of the slurry. Similarly, a flow rate of the slurry 46 may be increased or decreased to produce a corresponding increase or decrease in density of the slurry 50. This may be useful, for example, when during a fracturing operation a pressure spike indicates a need to quickly reduce the density of the slurry 50.

When the density of the slurry 50 is changed in the well, there is no lag time associated with clearing the work string 30 of the prior density slurry, as would be the case if the density of the slurry were changed by producing a different density slurry at the surface and then pumping it through the work string. Another advantage which follows from this benefit is that different layers in the zone 12 may be selectively fractured, for example, when one fracture in one layer sands out, pressure may be increased and the density of the slurry 50 may be quickly decreased to form another fracture in another layer, and then when this second fracture sands out, the process may be repeated again to form yet another fracture, etc. In the past, a slurry density could not be changed rapidly enough to effectively selectively fracture different layers.

Another benefit of the system 10 is that the slurry 50 can be delivered to the zone 12 at a greater rate than would otherwise be practical using a given size of the work string 30. By utilizing both the work string 30 and the annulus 34 to deliver the components of the slurry 50, more flow area is available and less flow resistance is encountered. In the past, flow resistance through the work string has been a major factor in limiting the rate at which a slurry could be pumped into a well.

Another benefit of the system 10 is that the fluid 48 deflects the slurry 46 downward as the slurry exits the ports 42 in the crossover 40. This deflection of the slurry 46 by the fluid 48 reduces erosion of the interior of the extension 24 and may reduce erosion of the crossover about the ports 42. In the past, erosion has been a major factor in limiting the rate at which a slurry could be pumped through a crossover.

Erosion is also reduced in the system 10 due to the fact that the slurry 46 can be pumped at a lower rate. That is, for a given desired flow rate of the slurry 50, the slurry 46 is pumped at a lower flow rate since the flow rates of the slurry 46 and the fluid 48 are combined to produce the flow rate of the slurry 50. Thus, a lower flow rate of the slurry 46 results in reduced erosion of the crossover 40, extension 24 and other components of the work string 30 and gravel packing assembly 18.

Another benefit of the reduced flow rate of the slurry 46 is that, where gels are used in the slurry, the reduced flows rate results in reduced shear in the gels, so that the gels do not break down as much. Furthermore, weighted fluid 48 in the annulus 34 may be used to increase fracturing pressure, without a need to pump the gels at a high rate through the work string 30. In other manners, the reduced flow rate of the slurry 46 can reduce damage to pumped fluids.

Another benefit of the system 10 is that gels can be delivered through the work string 30 at a relatively low flow rate and then be mixed with a weighted fluid (such as brine) or a pad (or brine above the pad) delivered via the annulus 34. The pad may be a gel-laden fluid used to initiate fracturing and could start with ammonia and follow with acid and then a slurry and gel, etc.

Another benefit of the system 10 is that the slurry 46 may be pumped down the work string 30 at a maximum density (for example, at a density of approximately 28 pounds per gallon). The slurry 46 is then mixed with the fluid 48 in the well to produce a desired reduced density of the slurry 50. Increasing the density of the slurry 46 reduces the flow rate of the slurry through the work string 30, thereby reducing erosion.

Another benefit of the system 10 is that by separately pumping the slurry 46 and the fluid 48 into the well, overall pumping capacity may be increased. For example, pumps available on a special fracturing skid or truck delivered to the well for the fracturing operation may be used to pump the slurry 46, while rig pumps may be used to pump the fluid 48.

Another benefit of the system 10 is that there is no need to move the work string 30 relative to the gravel packing assembly 18 in order to reverse circulate out the slurry 46 in the work string after the fracturing/gravel packing operation. Instead, pumping down the work string 30 is merely stopped, and the fluid 48 pumped down the annulus 34 is allowed to flow upward through the work string to reverse out the slurry 46.

Another benefit of the system 10 is that a smaller diameter work string 30 may be used to deliver a desired density of the slurry 50 at a desired rate. For example, coiled tubing could be used to deliver the slurry 46 at a very high density, but at a relatively low flow rate, so that unacceptable erosion of the coiled tubing is not experienced. It would be quicker and less expensive to use coiled tubing (or other small diameter tubing) rather than segmented tubing (or other large diameter tubing) for the work string 30.

Another benefit of the system 10 is that by pumping the slurry 46 through the work string 30 at a density greater than that of the slurry 50 delivered at the exterior of the screen 16 and/or pumped into the zone 12, a corresponding increased hydrostatic pressure is produced in the work string. This increased hydrostatic pressure is useful because it contributes to the fracturing pressure applied to the zone 12, thus reducing the pumping horsepower needed at the surface to generate the fracturing pressure.

Another benefit of the system 10 is that a smaller diameter work string may be used than would otherwise be required to pump a desired density of slurry at a certain rate and pressure. An additional benefit is that by using a smaller diameter work string, less time is required to reverse out the slurry in the work string, since less volume of the slurry is present in the work string. Yet another benefit of a reduced diameter work string is that it is easier to pump a packer setting ball on seat, and the ball can be reverse circulated out of the work string quicker.

Another benefit of the system 10 is that the downhole mixing makes other possibilities available. For example, one part of a two-part hardenable substance (such as an epoxy, foam, etc.) could be delivered through the work string 30, and the other part could be delivered through the annulus 34. In the past, hardenable substances such as epoxies have been mixed at the surface and then delivered through a tubular string. If a problem is encountered during the operation (such as a pump breakdown), the tubular string might have to be pulled with the mixed epoxy therein.

As another example, a gel could be delivered through the work string 30 and a breaker could be delivered through the annulus 34. In this way, the gel and breaker could be mixed just before being injected into the zone 12.

A gel could be flowed down the work string 30 and up into the annulus 34, with another fluid (such as water, brine, etc.) above the gel in the annulus. When the fracturing operation begins, the slurry 46 pumped down the work string 30 is mixed with the gel as the fluid 48 is pumped down the annulus 34.

As described above, the slurry 46 could be pumped down the annulus 34 and the fluid 48 could be pumped down the work string 30. Thus, the invention is not limited to the specific arrangements of the slurry 46 and fluid 48 described above.

One of the most important features of the invention is that multiple flowpaths are provided for separately and simultaneously delivering the slurry 46 and fluid 48 into the well, and these flowpaths may be provided in any configuration or arrangement, without departing from the principles of the invention. For example, multiple tubular strings could be used in place of the work string 30 and annulus 34, or multiple tubular strings could be used in addition to the annulus 34, to separately and simultaneously deliver multiple fluids into the well.

It is also not necessary for the slurry 46 and fluid 48 to be used in keeping with the principles of the invention. For example, the slurry 46 could instead be another fluid, or the fluid 48 could have proppant and/or gravel included therewith to form a slurry, etc. Thus, both of the slurry 46 and fluid 48 could be "clear" fluids, both of the slurry 46 and fluid 48 could be slurries, either of the slurry 46 and fluid 48 could have other components (such as gels, acids, ammonium, pads, etc.) combined therewith, either mixed or in stages, etc.

Figure 2A:
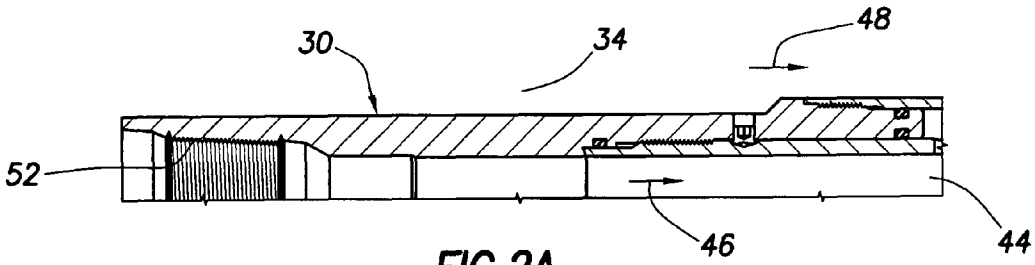
FIGS. 2A-P are quarter-sectional views of successive axial sections of portions of a work string and gravel packing assembly which may be used in the system and method of FIG. 1.
Figure 2B:
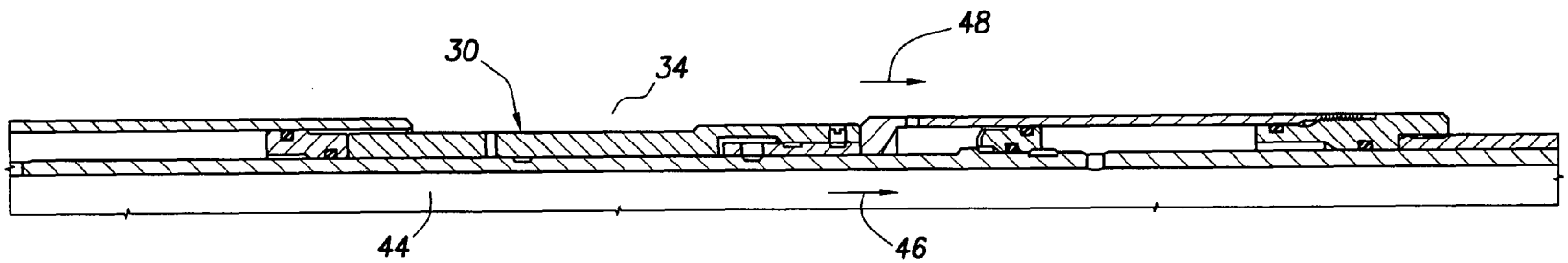
Figure 2C:
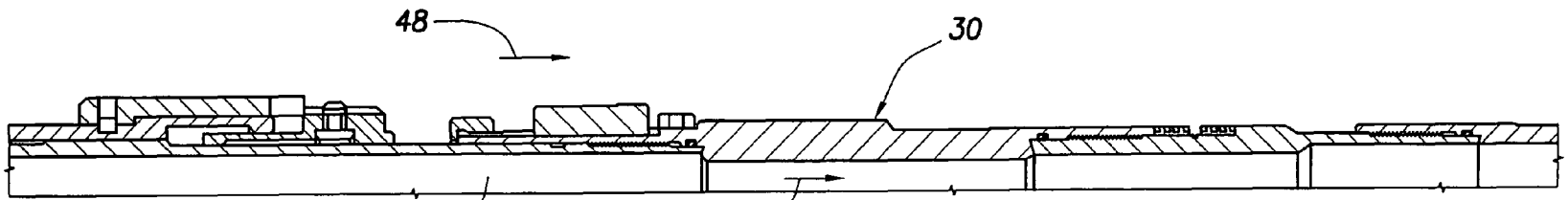
Figure 2D:
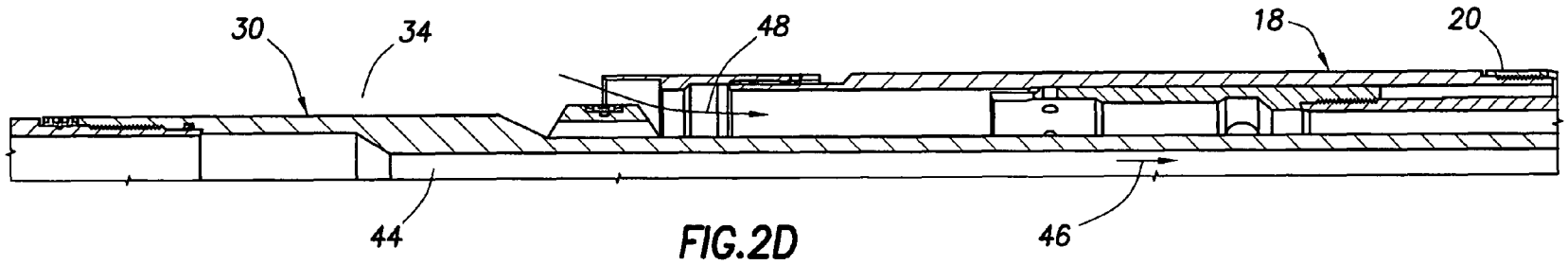
Figure 2E:
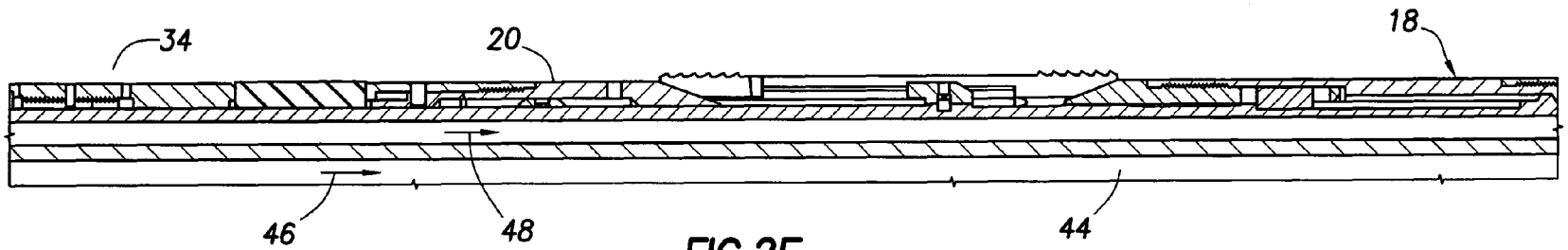
Figure 2F:
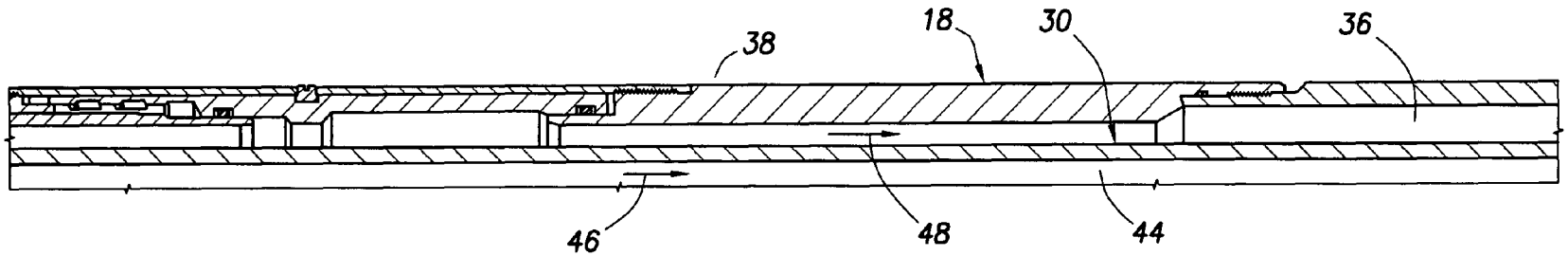
Figure 2G:
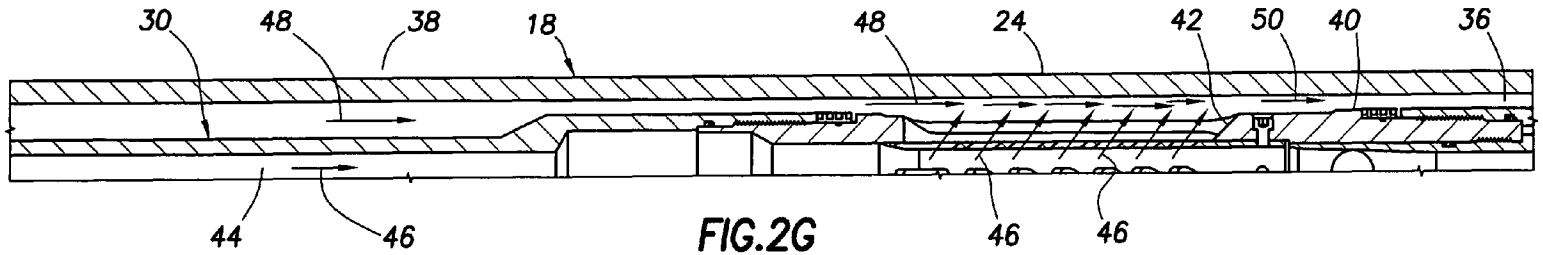
Figure 2H:
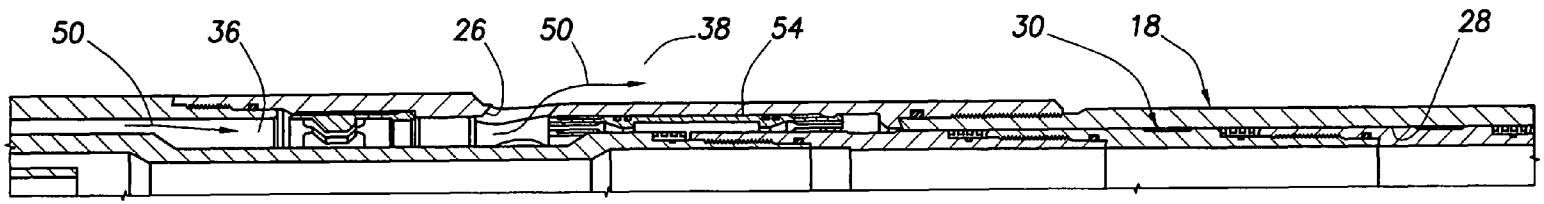
Figure 2I:
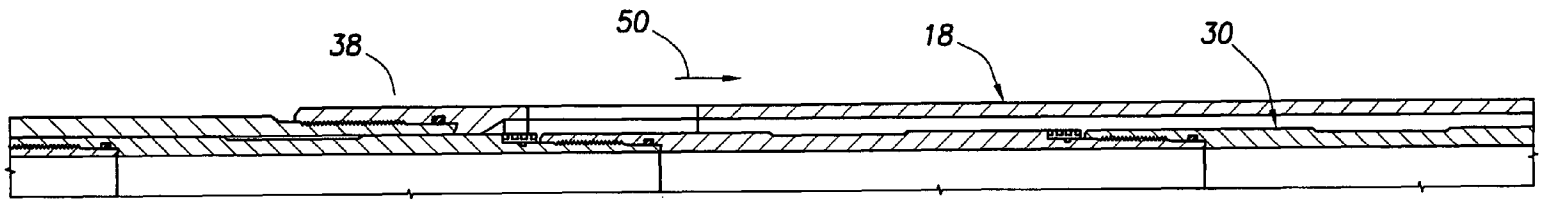
Figure 2J:
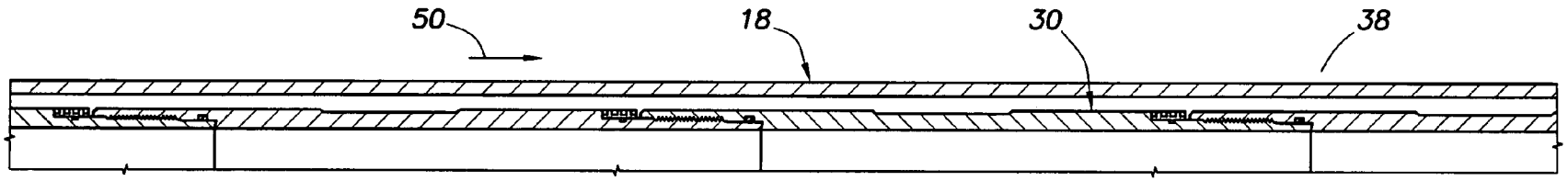
Figure 2K:
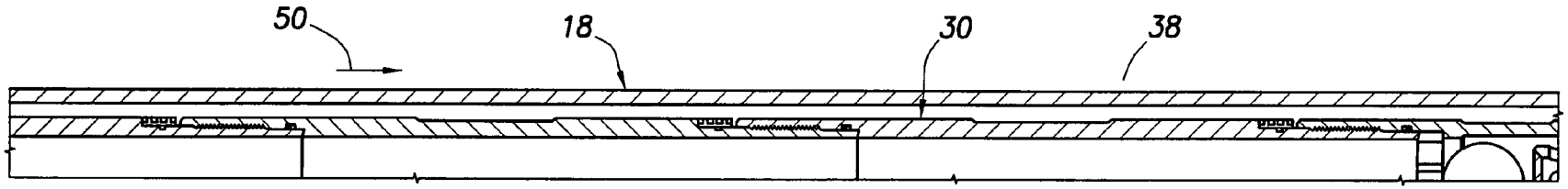
Figure 2L:
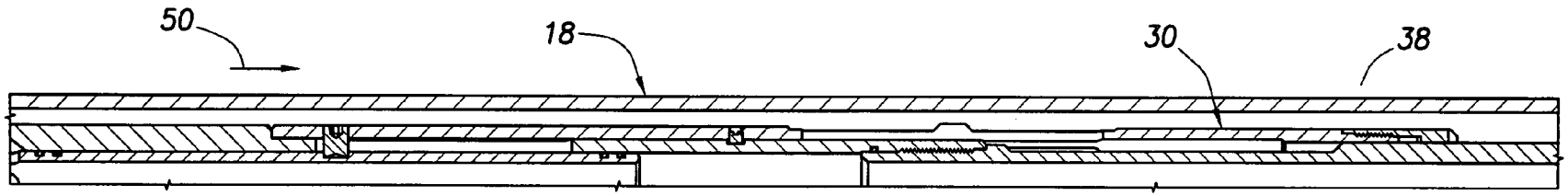
Figure 2M:
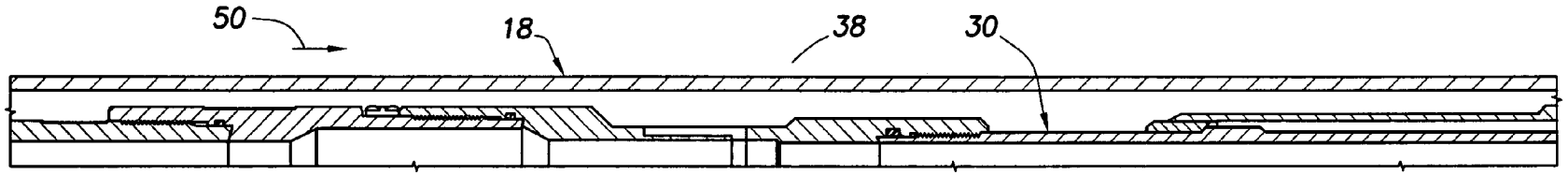
Figure 2N:
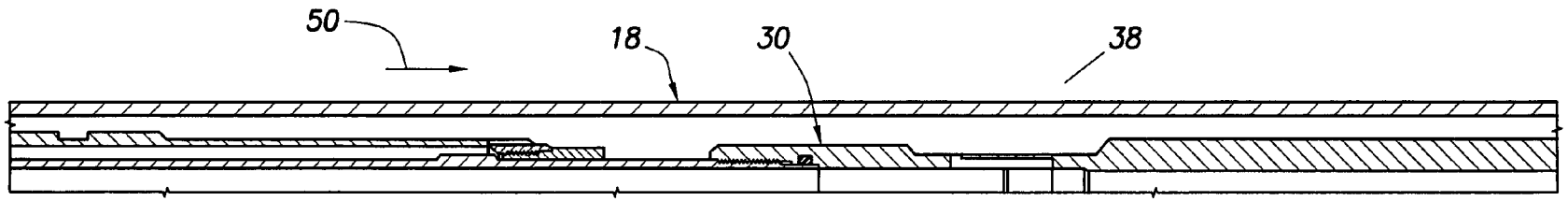
Figure 2O:
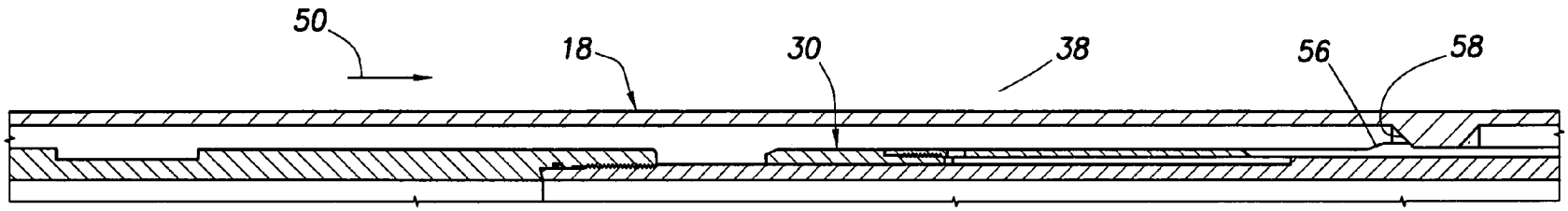
Figure 2P:
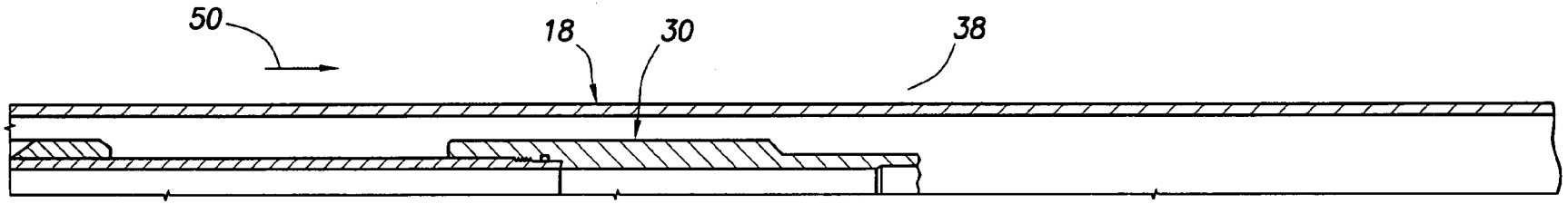

Referring additionally now to FIGS. 2A-P, more detailed views of portions of the gravel packing assembly 18 and work string 30 are representatively illustrated.

In FIG. 2A, an upper internally threaded end 52 is shown. This upper end 52 would be connected to a lower end of a tubular string in practice. The portion of the work string 30 below the end 52 may be referred to as a service tool.

In FIGS. 2D-F it may be seen that the work string 30 is detached from the packer 20 after the packer has been set. The work string 30 is raised relative to the gravel packing assembly 18 after the packer 20 is set, thereby permitting the fluid 48 to flow from the annulus 34 above the packer to the annular space 36 between the work string and gravel packing assembly.

Note that it is not necessary for the work string 30 to be detached from the packer 20 in keeping with the principles of the invention. In other embodiments the work string 30 could remain attached to the packer 20 while the fluid 48 is permitted to flow from the annulus 34 above the packer to the annular space 36 between the work string and gravel packing assembly 18, for example, by using a valve which permits such flow, etc.

In FIG. 2G the mixing of the fluid 48 with the slurry 46 in the annular space 36 may be seen. Note that the fluid 48 deflects the slurry 46 downward and thereby reduces erosion on the interior of the extension 24. The reduced density slurry 50 resulting from the mixed slurry 46 and fluid 48 flows downward through the annular space 36.

In FIG. 2H it may be seen that the slurry 50 flows outward from the annular space 36 to the annulus 38 below the packer 20 via the ports 26. Also visible in this view is a sleeve 54 which may be used to prevent flow through the ports 26.

In FIG. 2O, a collet 56 (known to those skilled in the art as a weight down collet) on the work string 30 is shown engaged with an internal shoulder 58 on the gravel packing assembly 18. This engagement between the collet 56 and shoulder 58 permits accurate positioning of the work string 30 relative to the gravel packing assembly 18 during the pumping of the slurry 50.

In FIG. 2P the slurry 50 is shown flowing downwardly through the annulus 38. The screen 16 would be connected in the gravel packing assembly 18 below FIG. 2P, and a washpipe would be connected in the work string 30 below FIG. 2P, as in conventional fracturing/gravel packing systems.

Figure 3:
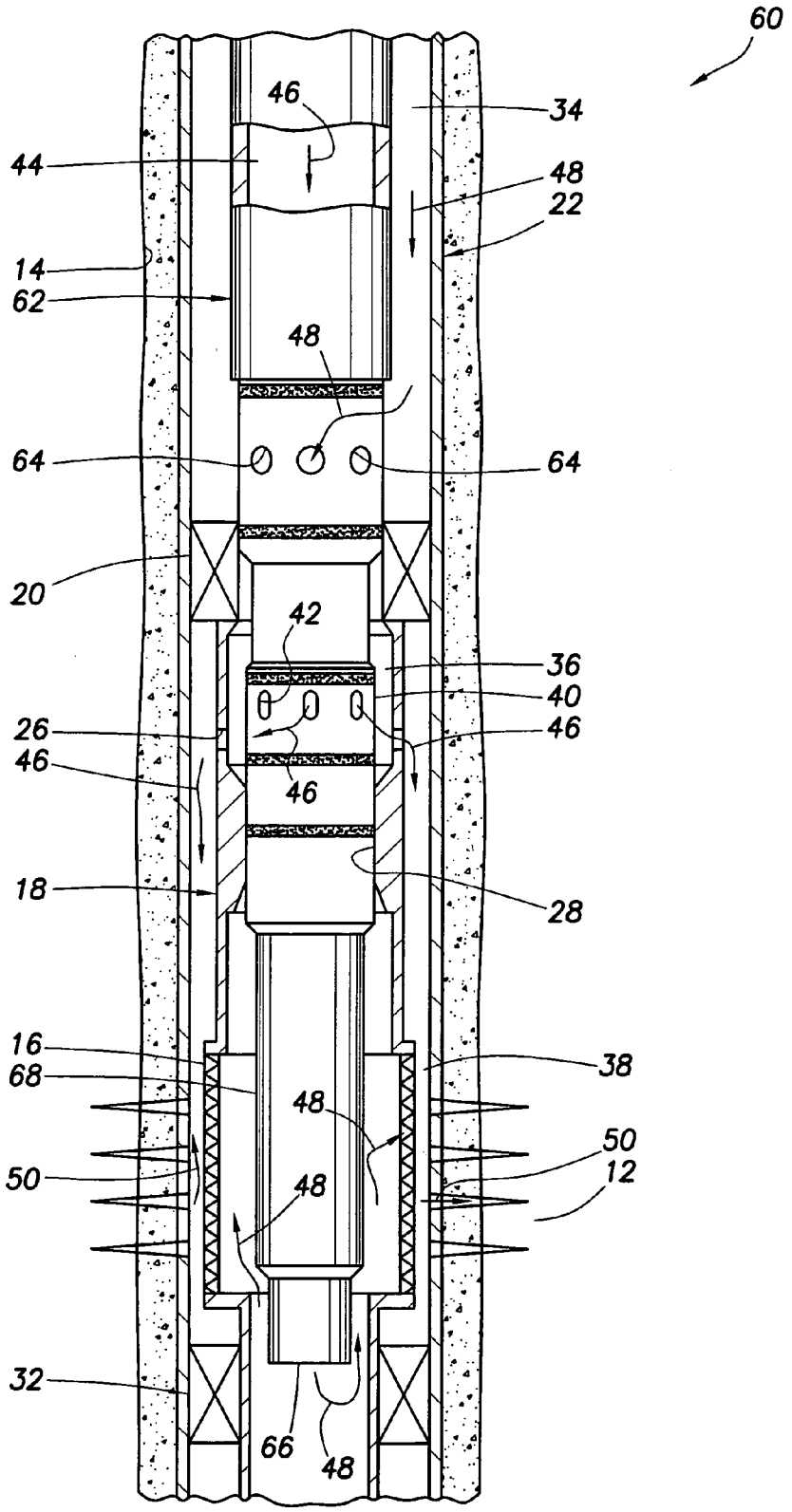
FIG. 3 is a schematic partially cross-sectional view of a second well treatment system and method embodying principles of the present invention.

Referring additionally now to FIG. 3, another well treatment system 60 and associated method embodying principles of the invention are representatively illustrated. The system 60 is similar in many respects to the system 10 described above, so elements shown in FIG. 3 which are similar to those described are indicated using the same reference numbers.

One difference between the system 60 and the system 10 is that the system 60 uses a somewhat different work string 62. In addition, the slurry 46 and fluid 48 are mixed in the annulus 38 external to the screen 16 instead of being mixed in the annular space 36 between the work string and the gravel packing assembly 18.

The work string 62 includes ports 64 which may be opened to provide communication between the annulus 34 above the packer 20 and the interior of the work string. The fluid 48 enters the ports 64 and flows through a flowpath separate from the passage 46. The fluid 48 then exits a lower end 66 of a washpipe 68 within the screen 16.

The slurry 46 flows from the passage 44 into the annulus 38 via the ports 42 and 26. As the fluid 48 flows through the screen 16 (from the interior to the exterior of the screen), the fluid is mixed with the slurry 46 in the annulus 38 external to the screen to thereby produce the reduced density slurry 50.

Note that the system 60 achieves all of the benefits and advantages of the system 10 described above, except that the fluid 48 does not deflect the slurry 46 as it exits the ports 42 in the crossover 40. However, the system 60 does result in mixing of the fluid 48 with the slurry 46 in even closer proximity to the zone 12.

Figure 4:
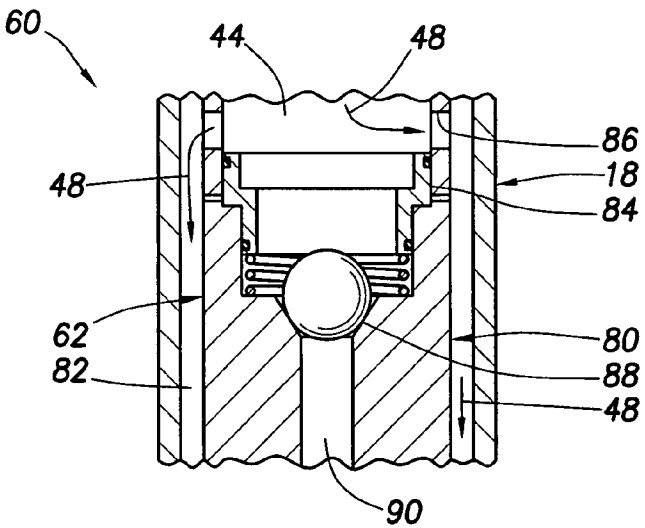
FIG. 4 is a schematic cross-sectional view of an alternate configuration of the second well treatment system and method.

Referring additionally now to FIG. 4, an alternate configuration of the system 60 is representatively illustrated. In this alternate configuration, a flow directing device 80 is provided in the work string 62 to direct the fluid 48 out of the work string and into an annular space 82 between the work string and the gravel packing assembly 18.

Preferably, the flow directing device 80 is interconnected in the work string 62 below the crossover 40, but above the washpipe 68 and screen 18. Thus, the fluid 48 does not flow out the end 66 of the washpipe 68, but instead exits the work string 62 above the washpipe.

The flow directing device 80 includes a one-way or check valve 84 which permits the fluid 48 to flow from the passage 44 to the annular space 82 via ports 86, but does not permit oppositely directed flow. The flow directing device 80 also includes another one-way or check valve 88 which permits fluid flow from a passage 90 in communication with the interior of the washpipe 68 to the passage 44, but does not permit oppositely directed flow.

The check valve 88 is useful during gravel packing operations to permit circulating fluid flow from the interior of the screen 16 to the annulus 34 above the packer 20, if the fluid 48 is not pumped down the annulus. During fracturing operations, the fluid 48 will be pumped downward through the annular space 82 after exiting the ports 86, to the interior of the screen 16, through the screen to the annulus 38, where the fluid will mix with the slurry 46.

Figure 5:
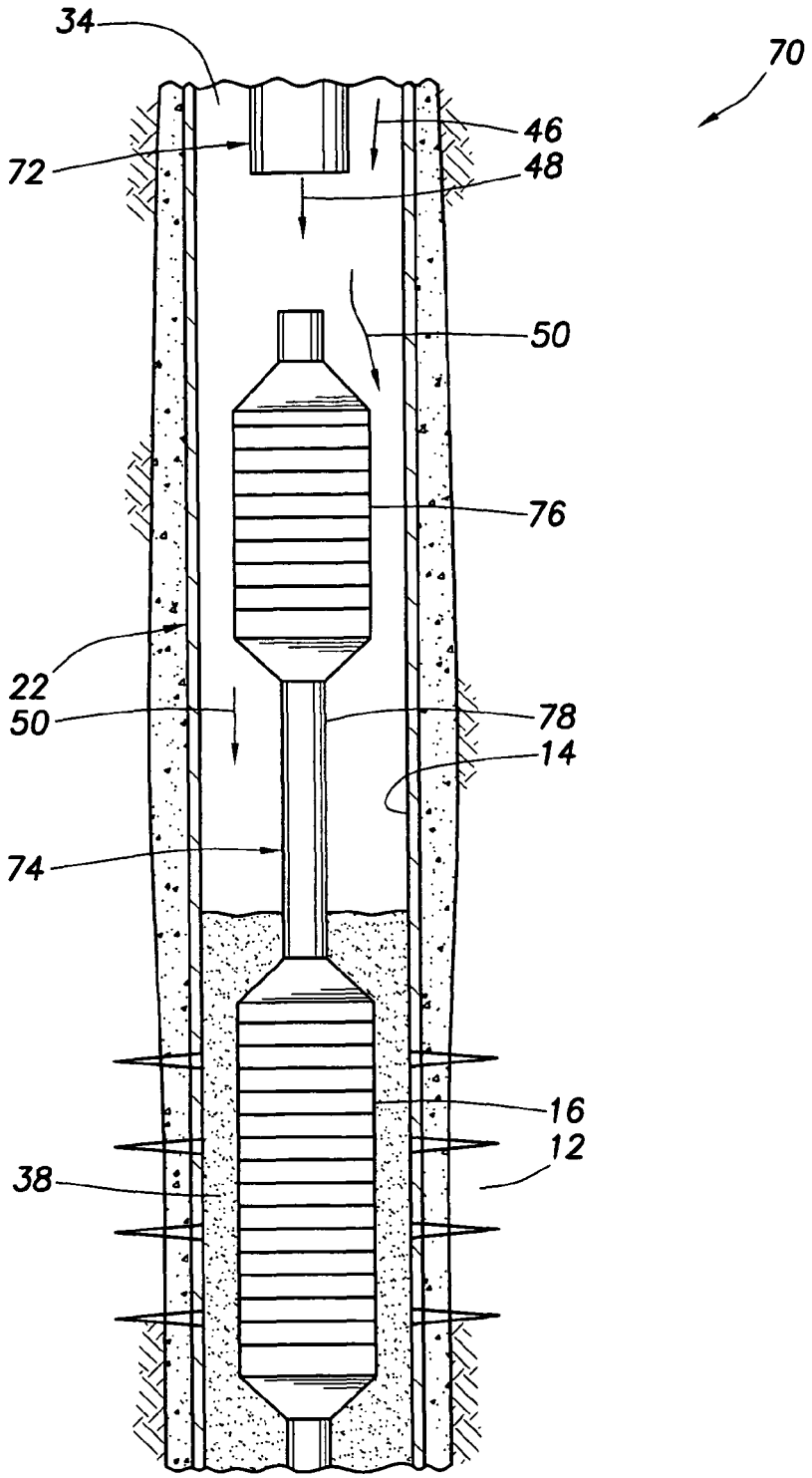
FIG. 5 is a schematic partially cross-sectional view of a third well treatment system and method embodying principles of the present invention.

Referring additionally now to FIG. 5, another well treatment system 70 and associated method embodying principles of the invention are representatively illustrated. The system 70 is similar in some respects to the systems 10, 60 described above, and so elements shown in FIG. 4 which are similar to those described above are indicated using the same reference numbers.

The system 70 utilizes a different work string 72 and a different gravel packing assembly 74 as compared to those described above for the systems 10, 60. The work string 72 is used to convey the gravel packing assembly 74 into the well, however, the work string is separated and raised away from the gravel packing assembly during fracturing/gravel packing operations.

The gravel packing assembly 74 includes the screen 16, as well as a vent screen 76 and a conduit 78 interconnected between the screen 16 and the vent screen 76. After gravel packing operations are concluded and while the well is produced, fluid will flow from the zone 12 into the screen 16, upward through the conduit 78, and outward through the vent screen 76 for production to the surface (such as through a production tubing string). Thus, the screen 16 is gravel packed in the annulus 38, but gravel is preferably not deposited about the vent screen 76.

As depicted in FIG. 5, during fracturing/gravel packing operations, the slurry 46 is flowed downwardly through the annulus 34, and the fluid 48 is flowed downwardly through the work string 72. This is opposite to the manner in which the slurry 46 and fluid 48 are delivered into the well in the systems 10 and 60 described above, but it should be clearly understood that the slurry could be (and is preferably) flowed through the work string 72, and the fluid can be (and is preferably) flowed through the annulus 34 in keeping with the principles of the invention.

The slurry 46 and fluid 48 are mixed below the work string 72 in the well to produce the reduced density slurry 50. The slurry 50 then flows into the annulus 38 about the screen 16.

Note that all of the benefits and advantages of the systems 10, 60 are achieved in the system 70, except that since no crossover 40 or extension 24 are used, erosion of these components is not a factor in the system 70.

Furthermore, note that it is not necessary in keeping with the principles of the invention for either a fracturing operation or a gravel packing operation to be performed. Either of these operations could be performed, neither of these operations could be performed, or a combination of these operations could be performed, without departing from the principles of the invention.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention.

For example, the slurry 46 could be mixed with the fluid 48 within the work string 30, 62, 72, if desired (such as, prior to being discharged from the crossover 40 or lower end of the work string 72). As another example, the density of the slurry can be changed continuously, instead of in discreet steps, to thereby continuously respond to changed conditions in the well.

Accordingly, the foregoing detailed description is to be clearly understood as being given by way of illustration and example only, the spirit and scope of the present invention being limited solely by the appended claims and their equivalents.

What is claimed is:

1. A method of treating a well, comprising the steps of:
flowing a first fluid into the well through a work string while simultaneously flowing a second fluid into the well through a first annulus formed between the work string and a wellbore;
mixing the first and second fluids in a second annulus formed between the work string and a gravel packing assembly prior to the mixed first and second fluids entering a third annulus formed between the gravel packing assembly and the wellbore; and
then directing the mixed first and second fluids to an exterior of a well screen in the well.

2. The method of claim 1, wherein at least one of the first and second fluids is included in a slurry flowed into the well, and wherein the mixing step further comprises altering a property of the slurry in the well.

3. The method of claim 1, wherein at least one of the first and second fluids is included in a slurry flowed into the well, and wherein the mixing step further comprises varying a property of the slurry in the well by varying a flow rate of at least one of the first and second fluids.

4. The method of claim 1, wherein the well screen is included in the gravel packing assembly.

5. A method of treating a well, comprising the steps of:
flowing a first fluid into the well through a work string while simultaneously flowing a second fluid into the well through a first annulus formed between the work string and a wellbore;
mixing the first and second fluids in the well prior to the mixed first and second fluids entering a second annulus formed between a gravel packing assembly and the wellbore; and
then directing the mixed first and second fluids to an exterior of a well screen in the well,
wherein the well screen is attached to a packer set in the wellbore, and wherein the second fluid flowing step further comprises flowing the second fluid between the work string and the packer.

6. A well treatment system, comprising:
a work string positioned within a wellbore, with an annulus formed between the work string and the wellbore;
a first slurry flowed into a well via one of the work string and the annulus; and
a fluid flowed into the well via the other of the work string and the annulus simultaneously with the first slurry being flowed into the well, the fluid being mixed in the well with the first slurry within an annulus formed between the work string and a gravel packing assembly, thereby producing a second slurry which exits the gravel packing assembly and then contacts an exterior of a well screen.

7. The system of claim 6, wherein a flow rate of at least one of the first slurry and the fluid is altered while the first slurry is flowed into the well to thereby cause the second slurry to have a first changed property in the well.

8. A method of treating a well, the method comprising the steps of:
installing a gravel packing assembly in the well, the gravel packing assembly including a well screen;
flowing a first slurry into the well via a first conduit;
simultaneously during the first slurry flowing step, flowing a fluid into the well via a second conduit;
mixing the first slurry with the fluid in an annular space within the gravel packing assembly, thereby producing a second slurry;

flowing the second slurry out of the gravel packing assembly; and then contacting an exterior of the well screen with the second slurry.

9. The method of claim 8, wherein during the mixing step a work string is positioned within the gravel packing assembly, and wherein the mixing step further comprises mixing the fluid with the first slurry in the annular space formed between the work string and the gravel packing assembly.

10. The method of claim 8, wherein the fluid includes a gel, and wherein the mixing step further comprises mixing the gel with the first slurry.

* * * * *